US006083014A

United States Patent [19]

Bogdan et al.

[11] Patent Number: 6,083,014

[45] Date of Patent: Jul. 4, 2000

[54] CONNECTOR FOR A SHIELDED CABLE

[75] Inventors: Gabriel Bogdan, Gummersbach; Britta Straesser, Sieburg; Dietmar Harting, Espelkamp; Achim Brenner, Luebbecke; Stephan Schreier, Rahden, all of Germany

[73] Assignees: Albert Ackermann GmbH & Co. KG, Gummersbach; Harting KgaA, Espelkiamp, both of Germany

[21] Appl. No.: 09/271,375

[22] Filed: Mar. 18, 1999

[30] Foreign Application Priority Data

Mar. 18, 1998 [DE] Germany ..... 298 04 836 U

[51] Int. Cl.[7] ..... H01R 13/648; H01R 9/03

[52] U.S. Cl. ..... 439/98; 439/610

[58] Field of Search ..... 439/98, 610, 409, 439/607–609; 174/84 R, 88 C, 86, 78

[56] References Cited

U.S. PATENT DOCUMENTS

| | | | |
|---|---|---|---|
| 4,744,769 | 5/1988 | Grabbe et al. | 439/284 |
| 5,199,891 | 4/1993 | Reed | 439/98 |
| 5,358,426 | 10/1994 | Henschen et al. | 439/497 |
| 5,435,747 | 7/1995 | Franckx et al. | 439/409 |
| 5,529,506 | 6/1996 | Onoda | 439/95 |
| 5,662,495 | 9/1997 | Inaba et al. | 439/610 |
| 5,688,145 | 11/1997 | Liu | 439/607 |
| 5,820,412 | 10/1998 | Koegel et al. | 439/610 |
| 5,895,292 | 4/1999 | Affeltranger | 439/610 |

FOREIGN PATENT DOCUMENTS

| | | |
|---|---|---|
| 87 18 095 U | 12/1993 | Germany . |
| 93 03 361 U | 5/1994 | Germany . |
| 19528235A1 | 2/1997 | Germany . |
| 23 12 341A U | 10/1997 | Germany . |
| 297 19 442 U1 | 4/1998 | Germany . |

OTHER PUBLICATIONS

Patent Abstracts of Japan, Sep. 13, 1996, Method and Structure for Joining Shield Wire and Drain Wire, 08236170A.

German Office Action, Aug. 24, 1998.

*Primary Examiner*—Lincoln Donovan
*Assistant Examiner*—Chandrika Prasad
*Attorney, Agent, or Firm*—Evenson, McKeown, Edwards & Lenahan, P.L.L.C.

[57] ABSTRACT

A connector for a shield cable has a braided shield connected by a ring provided at least on the circumference with conducting material. A shielding part of a base housing is provided with plug-in connections, and is adapted to receive wire ends forming contact with the plug-in connections. The ring is a slotted clamping ring which is pressed flexibly against a contact surface of the shielding part that matches its contour and against a recess in a housing part which together with the base housing forms a connector housing.

20 Claims, 2 Drawing Sheets

CONNECTOR FOR A SHIELDED CABLE

BACKGROUND AND SUMMARY OF THE INVENTION

This application claims the priority of German application 298 04 836.1, filed Mar. 18, 1998, the disclosure of which is expressly incorporated by reference herein.

The invention relates to a connector for a shielded cable whose braided shield is connected by a ring provided at least on the circumference with conducting material, with a shielding part of a housing provided with plug-in connections, said housing receiving the wire ends and forming the contact with the plug-in connections.

A connector of this type is known from German Patent Document No. DE 8718095 U1, in which the braided shield of the cable is folded backward by approximately 180 degrees over a ring and is then compressed together with the contact tabs of metal shields with the aid of a crimping ring. The wires of the cable are connected in known fashion with contacts and the metal shields are extended up to the terminal contacts. The connection of a shielded cable in this fashion requires a relatively large amount of effort, especially because of the required connection with the metal shields by a crimping ring.

The present invention has a goal of designing a connection of the species recited at the outset such that a simpler connection with the braided shield of the cable is possible.

To achieve this goal, provision is made in a connector of the species recited at the outset such that the ring is a slotted clamping ring pressed flexibly against a contact surface on the shielding part that matches its contour and abuts a recess in a housing part. With this design, the connection of the braided shield with the metal shields is achieved in simple fashion by the assembly of a two-part housing by which the flexible clamping ring produces the necessary contact with the metal shield. The separate squeezing of a crimping ring is superfluous. The connection to the braided shield of the cable is made simultaneously with the assembly of the housing.

In an improvement on the invention, the wires of the cable can be received in guides of a wire carrier that consists of insulating material, said carrier being located separately from the housing or movably thereon, with openings being provided in the wire carrier that lead to the guides for the wires, and contact tips are provided that extend transversely to the connection direction in the housing, said tips contacting the wires through the openings when the wire carrier is inserted into the housing and connecting with plug-in contacts in the chambers of the housing that are open to the outside. With this design, the wires can be introduced in a relatively simple fashion into the wire carrier which is initially still loose and is then inserted into the housing.

In an improvement of the invention, the shielding part can have outwardly flexible tongues in the area of the plug extensions for connecting a bushing and the entire plug housing can be surrounded by a protective cap of non-conducting material into which metal shields can be inserted.

Other objects, advantages and novel features of the present invention will become apparent from the following detailed description of the invention when considered in conjunction with the accompanying drawings.

DETAILED DESCRIPTION OF THE DRAWINGS

Figure 1:
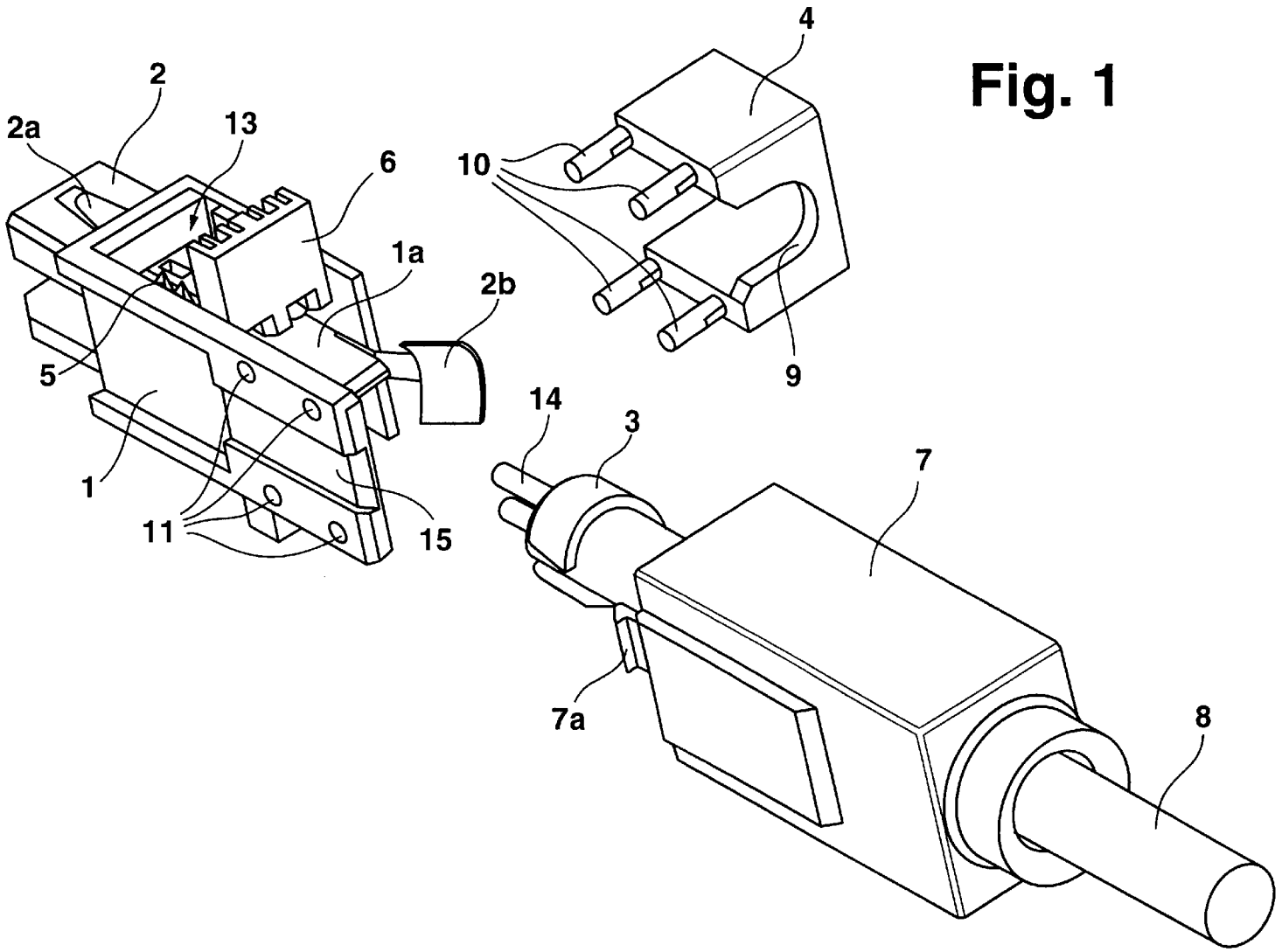
FIG. 1 is a perspective exploded view of the various parts of a connector constructed according to preferred embodiments of the invention.
Figure 2:
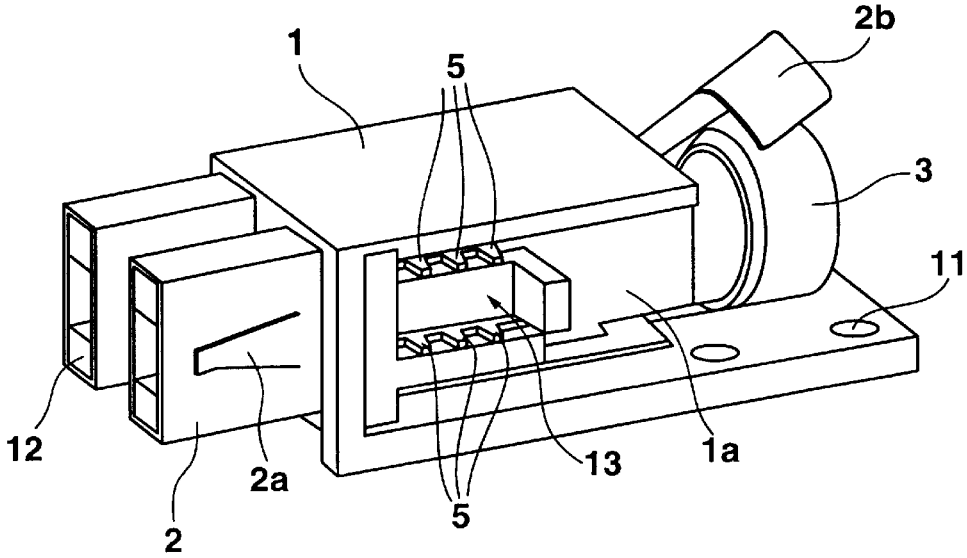
FIG. 2 is a perspective view of the plug area prior to assembly.
Figure 3:
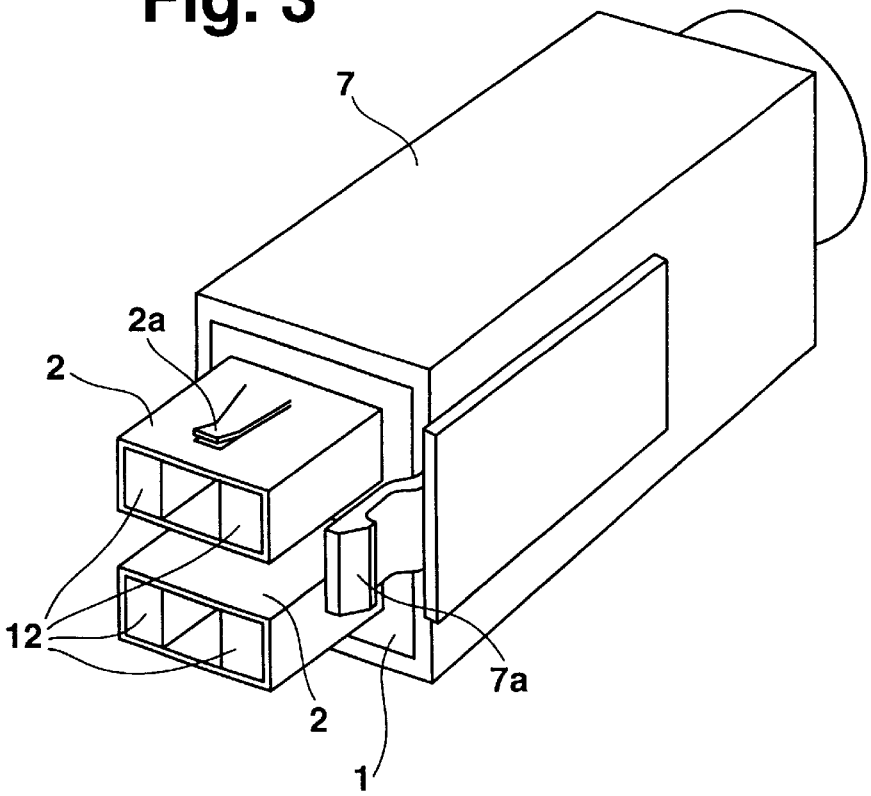
FIG. 3 shows the completely assembled plug.

The connector shown in FIGS. 1 to 3 for connecting a flexible twisted pair cable 8 consists of a shielded base housing 1 with a partition la that protects the wire pairs against mutual electrical influence. Metal shields 2 are inserted into this housing 1 which are shaped as sleeves in the later plug area and have lateral flexible tongues 2*a* that serve to contact the shielding of a bushing, not shown, and thus make the shielding continuous between the plug and bushing.

The metal shields 2 are formed continuously by housing 1 and in a connecting area have tabs 2*b* in the shape of half-shells which must then be brought into contact with the braided shield, not shown, of cable 8. These tabs 2*b* have a convexity that is approximately the same as the radius of cable 8. A slotted clamping ring 3 is associated with cable 8 on the side facing housing 1, over which ring the braided shield of cable 8 is placed in known fashion following the stripping of the outer insulation and which ring then, together with half-shells 2*b,* is clamped in the semicircular recess 9 of a shielded covering cap or hood 4 and because of its spring action presses against tab 2*b* and recess 9. Covering cap 4 is inserted by the plug pins 10 into matching openings 11 in housing 1 and latches there.

Insulating bodies 12 are inserted into metal shielding 2 and hold the plug contacts (not shown). These plug contacts are pulled into the interior of the housing and project there with contact tips 5 into recesses 13 on each side of partition la into which a wire carrier 6 can be inserted. This wire carrier 6 is designed in a manner known of itself so that the wire ends 14 of cable 8 are inserted into matching guides. When wire carrier 6, which in FIG. 1 is still lying loosely in front of recess 13, is inserted into recess 13 following a 90-degree rotation relative to the position shown in FIG. 1, the contact tips 5 enter matching openings in wire carrier 6 and provide guidance there since the openings are flush with guides for the wire ends to connect the wire ends. Wire carrier 6 in FIG. 1 is shown as a separate part. It is also contemplated to inject this wire carrier 6, for example by a film hinge or the like, on housing body 1.

Finally, a protective cap 7 is provided that consists of a material that is not an electrical conductor. A metal shield can be inserted into this protective cap 7. The protective cap 7 is pushed over housing 1 with housing part 4 mounted and the wire carrier inserted. The protective cap 7 has a latching hook 7*a* which, when the plug shown is assembled with a bushing, not shown, latches with the latter.

The novel plug therefore comprises housing 1 with the preassembled contacts with contact tips 5 and of two wire carriers 6, each of which serves to guide wires in pairs. The plug also consists of covering hood 4 which serves for connecting the shielding and for stress relief of cable 8 which is then clamped by a clamping ring 3, as well as of the protective cap 7 which can then be pushed over housing 1 and covering cap 4.

Cable 8 is assembled as follows: Initially the cable is trimmed to the desired length and the protective cap 7 and clamping ring 3 are then placed on the cable. The cable jacket is then stripped and the braided shield exposed. The existing film is removed from the wire pairs for connection. Clamping ring 3 is then positioned between tabs 2*b* of metal shields 2, the braided shield of cable 8 is pulled over clamping ring 3, and then covering cap 4 is pressed on with pins 10 entering openings 11.

The individual wires of the wire pairs are then clamped in the slots of a preferably transparent wire carrier 6 and the projecting parts of the wires are trimmed. Then wire carrier 6 is pushed onto the insulating body of housing 1 with contact tips 5 so that when the three contact tips 5 penetrate the wire insulation, the electrical contact is made. Then protective hood 7 is pulled over the assembled housing. The flexible snap hook 7*a* is then located on the underside of the housing where a matching recess 15 is provided.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Connector for a shielded cable whose braided shield is connected by a ring provided at least on the circumference with conducting material, with a shielding part of a base housing provided with plug-in connections, said housing receiving wire ends and forming contact with the plug-in connections, wherein the ring is a clamping ring which is pressed flexibly against a contact surface of the shielding part that matches its contour and against a recess in a housing part and wherein the shielding part is formed integrally with the base housing and includes a movable tab which in use contacts the clamping ring.

2. Connector according to claim 1, wherein the housing part is designed as a covering cap that is pressed with pins formed thereon into matching openings in a baseplate of the base housing.

3. Connector according to claim 1, wherein the wires of the cable are received in guides of a wire carrier consisting of insulating material, said carrier being located separately from the base housing or movably mounted thereon, wherein openings are provided in the wire carrier, each of which leads to respective guides for the wires, and wherein contact tips projecting transversely to an insertion direction are provided on the base housing which, when the wire carrier is inserted, connect the wires through the openings and come in contact with plug-in contacts in chambers of the base housing that are open to the exterior.

4. Connector according to claim 2, wherein the wires of the cable are received in guides of a wire carrier consisting of insulating material, said carrier being located separately from the base housing or movably mounted thereon, wherein openings are provided in the wire carrier, each of which leads to respective guides for the wires, and wherein contact tips projecting transversely to the insertion direction are provided on the base housing which, when the wire carrier is inserted, connect the wires through the openings and come in contact with plug-in contacts in chambers of the base housing that are open to the exterior.

5. Connector according to claim 3, wherein the wire carrier is inserted into recesses on both sides of a partition that passes through the base housing.

6. Connector according to claim 4, wherein the wire carrier is inserted into recesses on both sides of a partition that passes through the base housing.

7. Connector according to claim 1, wherein the shielding part, in the vicinity of the plug extensions, has outwardly flexible tongues for connecting a bushing.

8. Connector according to claim 2, wherein the shielding part, in the vicinity of the plug extensions, has outwardly flexible tongues for connecting a bushing.

9. Connector according to claim 3, wherein the shielding part, in the vicinity of the plug extensions, has outwardly flexible tongues for connecting a bushing.

10. Connector according to claim 5, wherein the shielding part, in the vicinity of the plug extensions, has outwardly flexible tongues for connecting a bushing.

11. Connector according to claim 1, wherein the base housing with covering cap is surrounded by a protective cap made of non-conducting material.

12. Connector according to claim 2, wherein the base housing with covering cap is surrounded by a protective cap made of non-conducting material.

13. Connector according to claim 3, wherein the base housing with covering cap is surrounded by a protective cap made of non-conducting material.

14. Connector according to claim 5, wherein the base housing with covering cap is surrounded by a protective cap made of non-conducting material.

15. Connector according to claim 7, wherein the base housing with covering cap is surrounded by a protective cap made of non-conducting material.

16. Connector according to claim 11, wherein metal shields are inserted into the protective cap.

17. Connector according to claim 16, wherein the protective cap is provided with at least one flexible latching hook.

18. Connector according to claim 1, wherein the clamping ring is a slotted clamping ring.

19. Connector according to 4, wherein the clamping ring is a slotted clamping ring.

20. Connector according to claim 12, wherein the clamping ring is a slotted clamping ring.

* * * * *